United States Patent [19]

Saunders

[11] 4,367,996

[45] Jan. 11, 1983

[54] TAB OPENER END CLOSURE ASSEMBLY METHOD

[75] Inventor: William T. Saunders, Weirton, W. Va.

[73] Assignee: National Steel Corporation, Pittsburgh, Pa.

[21] Appl. No.: 233,570

[22] Filed: Feb. 11, 1981

[51] Int. Cl.[3] ..... B21D 51/00

[52] U.S. Cl. ..... 413/14; 220/270; 413/19

[58] Field of Search ..... 413/14, 12, 13, 18–20, 413/66, 58–61, 25; 220/269, 270, 378

[56] References Cited

U.S. PATENT DOCUMENTS

| | | | |
|---|---|---|---|
| Re. 28,910 | 7/1976 | Dolli | 413/17 |
| 3,868,918 | 3/1975 | Smith | 413/17 |
| 4,130,074 | 12/1978 | Cudzik | 220/269 |
| 4,148,410 | 4/1979 | Brown | 220/269 |
| 4,257,529 | 3/1981 | Saunders | 220/269 |
| 4,280,427 | 7/1981 | Potts | 413/15 |

*Primary Examiner*—Leon Gilden

*Attorney, Agent, or Firm*—Shanley, O'Neil and Baker

[57] ABSTRACT

An improved tab opener and retained-tab easy-open structure and end closure assembly method are disclosed. The tab opener is fabricated from flat-rolled sheet metal to present a rounded edge periphery. In preparing an end closure for assembly on a can body, the tab opener is secured to the end closure such that the raw edge sheet metal of the rounded periphery is disposed outwardly in relation to the can body. The raw edge metal, scorelines, and other portions of the end closure needing repair can be repaired simultaneously after securing the tab opener to the end closure.

5 Claims, 8 Drawing Figures

FIG.5
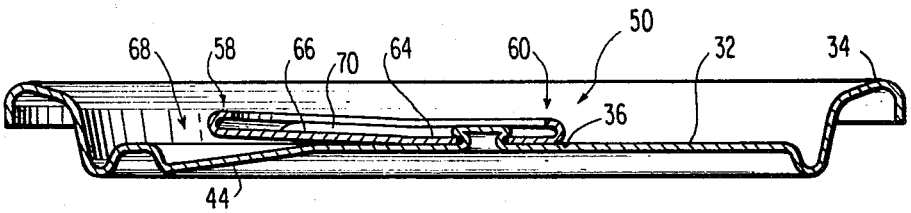
FIG.6
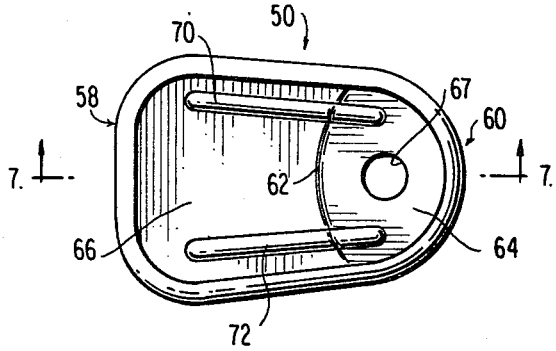
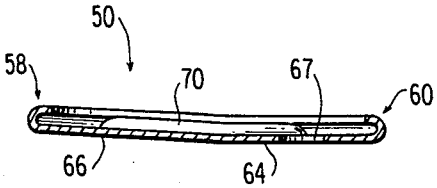
FIG.7
FIG.8
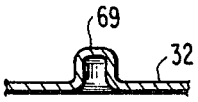

TAB OPENER END CLOSURE ASSEMBLY METHOD

This invention is concerned generally with easy-open sheet metal end closures for can bodies and their manufacture.

In particular, the invention is concerned with facilitating assembly of endwall closures and an improved tab opener particularly adapted to easy-open retained-tab uses.

Other advantages and contributions of the invention are set forth more specifically in a detailed description of embodiments shown in the accompanying drawings. In these drawings:

FIG. 5 is a cross-sectional view along line 5—5 of FIG. 4;

FIG. 6 is a plan view of the tab opener of the present invention;

FIG. 7 is a cross-sectional view along lines 7—7 of FIG. 6; and

FIG. 8 is a partial view in cross section of an end closure panel with rivet button.

Figure 1:
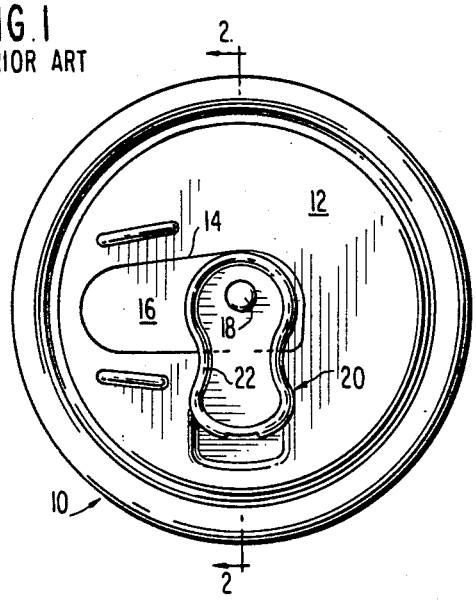
FIG. 1 PRIOR ART
FIG. 1 is a plan view of the external surface of a prior art end closure with tab opener.
Figure 2:
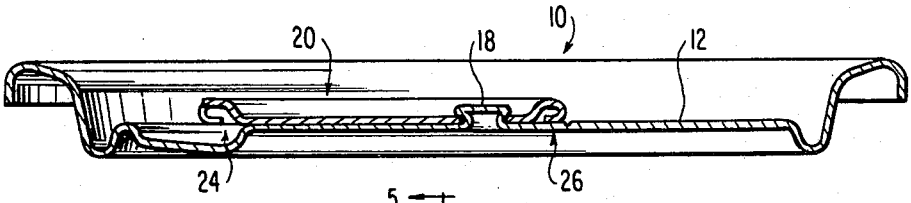
FIG. 2 PRIOR ART
FIG. 2 is a cross-sectional view along line 2—2 of FIG. 1.

In the embodiment of FIGS. 1 and 2, end closure 10 presents panel 12 with scoreline 14 defining a serverable tab 16. Rivet 18 secures tab opener 20 to the end closure in the conventional manner. This embodiment is described in detail in applicant's copending Application Ser. No. 29,345, filed Apr. 12, 1979.

As seen in FIG. 2, the rounded edge for tab opener 20 is provided by folding over edge metal in a direction to confront the panel 12 as assembled. As a result, the raw edge of the sheet metal is disposed on the underside of the tab 20; this is best seen at the handle-end portion 24 and working-end portion 26 of tab opener 20.

Figure 3:
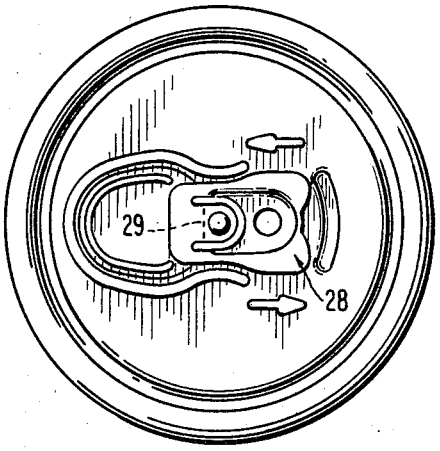
FIG. 3 PRIOR ART
FIG. 3 is a plan view of the external surface of another prior art end closure with tab opener.

FIG. 3 shows an embodiment of the retained-tab easy-open end concept which is widely used commercially. In fabricating tab opener 28, the sheet metal is folded over toward the panel and assembly is such that the folded-over metal is disposed inwardly toward the container.

This practice of folding edge metal inwardly toward the container developed with the early ring-pull concept and has been consistently followed in all known prior embodiments of the retained-tab concept.

The present invention departs from such long-established practice in providing an improved tab opener, a novel assembly method for a container closure, and new easy-open end closure with retained opener and tab. An elongated tab opener is fabricated to provide sufficient longitudinal strength to withstand, without bending, the lever-action force required to rupture a scoreline in a sheet metal wall and with a configuration which enables opening by an upward pushing motion in place of the lifting action required initially with prior tab openers.

With the present teachings flat-rolled steel can be readily and economically used. Flat-rolled metal in relatively soft metallurgical condition can be used to substantially eliminate break-off of the tab opener handle experienced with the prior aluminum retained-tab structures in wide commercial usage. Such break-off can readily occur because of metallurgically hard conditions which must be developed for strength purposes in such retained-tab practice. With the full-hard aluminum tab openers conventionally provided, there is a tendency, in the opening procedures required in the commercial retained-tab structure, for the tab itself to break off after the initial rupturing step upon return of the handle to a position substantially parallel to the endwall panel; occurrence of such break-off is especially prevalent if the handle is flexed more than once in order to assure full movement of the retained tab out of the opening. The embrittlement which results from such flexing of metallurgically hard aluminum tab openers is likely to manifest itself by breaking off of the tab handle near the rivet; for example along dotted line 29 of FIG. 3. Even though the opening tab is retained, break-off of the tab handle defeats the basic purpose of the retained-tab concept so that special measures and added structure, not part of or required by the present invention, have had to be devised to overcome this shortcoming.

Use of flat-rolled steel in the manufacture of tab openers for use with the retained-tab concept is facilitated by the ease of repair of the raw edge metal presented in forming the rounded-edge periphery of the present invention. Further, the assembly taught also facilitates economic manufacture since raw edge metal repair and other required end closure repair procedures for both interior and exterior end closure surfaces can be carried out in the same assembly line and cured simultaneously.

In addition, in opening a retained-tab closure, the invention provides a smooth contact surface for initiating rupture and for the severing stages. Such initial rupture and tab severing are carried out in moving the tab opener handle in a direction away from the container and generally require the largest force in the opening procedure. This force is applied on the underside of the tab opener used in retained-tab practice and, with the configuration taught, is applied on a smooth surface of extended area near the rounded-edge handle portion of the tab opener.

Figure 4:
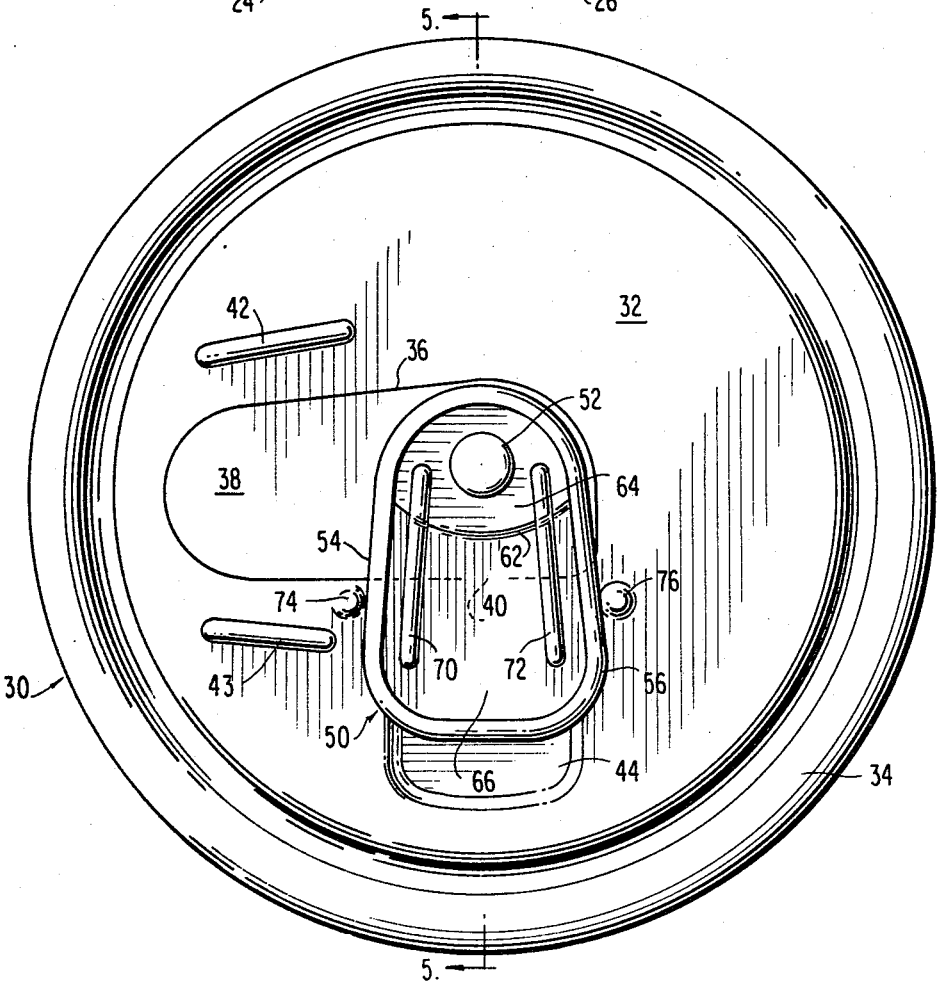
FIG. 4 is a plan view of the external surface of an end closure with tab opener embodying the present invention.

Referring to FIGS. 4 and 5, end closure 30 is fabricated from a sheet metal end closure blank by countersinking panel 32 to present a substantially planar panel circumscribed by border 34 which provides chime seam metal. Scoreline 36, of reduced sheet metal thickness, defines a severable tab portion 38 which can be moved from the plane of panel 32 to provide an opening; tab 38 is retained with panel 32 by panel hinge 40. Reinforcing ribs 42, 43 and recess 44 can also be formed in panel 32 during such fabrication.

With the present invention, tab opener 50 as fabricated can be attached directly to tab 38, by rivet 52, without interruption of the manufacturing assembly process; i.e. without requiring an added step, separate from the tab opener fabrication line, of repairing raw edge metal around the periphery of the tab opener.

As best seen in FIG. 5, folded-over sheet metal which forms a peripheral rounded edge is disposed outwardly in relation to the container, when assembled, rather than inwardly toward the container. Such outwardly disposed folded-over edge metal extends at least around handle end 58 and along a major portion of longitudinal side edges 54, 56 (FIG. 4); in the embodiment shown, folded-over edge metal is also utilized at working end 60 of the tab opener 50. Note that the curled-over edge metal is disposed on the outer surface rather than on the underside of the tab opener where it would be substantially inaccessible for repair after assembly.

A further feature to facilitate ease of opening and access for opening is provided by the present invention. The tab opener of FIGS. 4 and 5 is divided, along its length, into two substantially planar portions which are in slightly angled relationship to each other, such angled relationship occurring about contour line 62. A planar portion 64 is disposed during assembly about rivet 52 in substantially parallel relationship to the end closure panel 32 and, an elongated planar portion 66, on the longitudinally opposite side of line 62 toward handle end 58, is disposed in slightly outwardly angled relationship to the plane of panel 32. This angled relationship provides access, as indicated at 68, for applying an upward pushing force at handle end 58 to replace the more difficult pulling action required initially in prior commercial practice. This upward pushing force is applied at a smooth planar portion on the underside of the handle end 58 of tab opener 50. Recess 44 can augment the access available; the configuration is best seen in cross section in FIG. 5; recess 44 can be of smaller dimension than prior art requirements and can shallow-out quickly toward the plane of panel 32.

As seen in FIGS. 6 and 7, an aperture 67 is cut into the planar portion 64 of tab opener 50 for placing the tab opener over a conventionally formed rivet button 69 (FIG. 8) in panel 32 for forming rivet 52. Fabricating a sheet metal blank to form tab opener 50 by cutting out aperture 67 for rivet button 69, folding over edge metal, establishing planar sections 64, 66 about bend line 62, and such steps as forming reinforcing ribs 70, 72, can proceed without concern for repair of raw edge metal on the tab opener or concern for separate repair of end closures and tab openers prior to assembly.

The tab opener 50 with peripheral folded-over metal disposed outwardly, as disclosed above, is fed into the end closure assembly line and positioned for rivet securing with the longitudinal axis of the tab handle in preselected angular relationship to the longitudinal axis of tab 38; such longitudinal axis relationship is dependent on the type of retained tab end closure being assembled; the present teachings on tab opener configuration and assembly can be applied to other axis alignment embodiments. After placement, rivet 52 is formed in the conventional manner to secure the tab opener 50 to tab 38. Other tab positioning means, in addition to rivet 52, such as protrusions 74, 76 in panel 32, can be utilized to better maintain a desired positional relationship between the tab handle 50 and tab portion 38 for desired opening procedures.

With the tab opener 50 in position, repair procedures can be carried out. Internal and external surface coatings of the end closure can be repaired, e.g. at the rivet button, scorelines, reinforcing profiles, etc., along with the raw edge metal of the tab opener 50. This permits the assembled and repaired structures to be delivered for a single drying or curing step to complete manufacture of end closure 50.

Typically an elongated, retained-tab opener for a pour feature beverage can would have a longitudinal length of about $1\frac{1}{8}$ inches (about 2.8 mm), a width at its handle end of about $\frac{3}{4}$ inch (about 2 mm), and a width at its working end of about $\frac{5}{8}$ inch (about 1.5 mm). Measured along the longitudinal axis of the tab opener, the planar portion (66) at the handle end of the opener would have a length of about $\frac{5}{8}$ inch (about 1.7 mm) and the planar portion (64) at the working end of the opener would have a length of about $\frac{1}{2}$ inch (about 1.1 mm). The folded-over edge metal along sides (54, 56) maintains a longitudinally rigid angled relationship of such planar portions (64, 66).

When the tab opener embodiment of FIGS. 4 and 5 is fabricated from flat-rolled steel, the tab opener blank would have a thickness gage of about 0.013 inch (about 118 #/bb tinplate); the peripheral rounded edge would have an external radius of about 0.3 inch. Electroplate zinc or other metallic coatings can be used with flat-rolled steel.

When using flat-rolled aluminum, the tab opener blank would have a thickness gage of about 0.014 inch with peripheral rounded edge external radius of about 0.3 inch.

Typically internal surface repair materials for a beverage container would include epoxy, vinyl, or acrylic, and, typical repair materials for an external surface of an end closure would include epoxy or vinyl; such internal and external repair materials can be cured by similar procedures (or simultaneously).

Individual steps, in the novel assembly method taught, such as the countersinking of the end closure panel, scoreline and rivet button formation, establishing profile ribs and recesses, as disclosed above, can be carried out conventionally with established procedures and tooling known in the art.

While specific configurations and materials have been set forth in describing a specific embodiment of the invention, it should be understood that changes in juxtaposition of elements, scoreline and profiling rib configurations and changes in material, can be resorted to by those skilled in the art in the light of the above teachings. Therefore, in determining the scope of the present invention, reference should be had to the appended claims.

I claim:

1. Manufacturing method for an easy-open sheet metal endwall closure for a container, comprising (A) providing a sheet metal endwall blank, (B) fabricating such endwall blank for use as an easy-open endwall closure including the steps of forming such blank to present a substantially planar panel, scoring such panel to define a severable portion to be moved from the plane of such panel upon opening of a container, and forming a rivet button in the panel for use in securing a tab opener to such panel, (C) providing a sheet metal tab opener blank, (D) fabricating such tab opener blank for use as a tab opener having an elongated configuration with a working portion and a handle portion at longitudinally opposite ends, including the steps of folding over peripheral edge portions of such tab opener blank to form a double thickness of sheet metal with rounded edge at least around such handle portion and extending longitudinally along a major portion of the side edges of the tab opener blank toward such working end, such edge metal being folded over in a direction to be disposed outwardly when assembled on an end closure with raw edge metal accessible after assembly, and forming an aperture near the working end of the tab opener for placement over a rivet button, (E) placing such tab opener aperture over such rivet button in the panel portion of the end closure such that the folded-over edge metal of the fabricated tab opener is disposed outwardly, to provide for repair of such edge metal, when such end closure is prepared for assembly on a container, (F) converting such rivet button to a rivet to secure the fabricated tab opener to the fabricated end closure, and then (G) applying protective coating to such end closure including repair of such raw edge sheet metal at the periphery of such tab opener.

2. The method of claim 1 in which portions of such end closure to be disposed both externally and internally as assembled on a container are repaired in step (G).

3. The method of claim 1 in which fabricating of the tab opener further includes the steps of shaping such tab opener blank to form two planar portions in rigid angled relationship to each other, one planar portion being at the working end and the remaining planar portion being at the handle end of the fabricated tab opener.

4. The method of claim 3 in which the fabricated tab opener is assembled on the fabricated end closure with such working-end planar portion riveted in parallel relation to such end closure panel with such handle-end planar portion being in angled relationship to such end closure panel.

5. The method of claim 2 further including, after such repair, the step of (H) simultaneously curing such applied coating.

* * * * *